United States Patent [19]

Huh et al.

[11] Patent Number: 4,919,792

[45] Date of Patent: Apr. 24, 1990

[54] CLARIFICATION OF SLURRY OIL

[75] Inventors: Billy K. Huh, Lawrenceville, N.J.; Tsoung Y. Yan, Philadelphia, Pa.

[73] Assignee: Mobil Oil Corporation, New York, N.Y.

[21] Appl. No.: 206,238

[22] Filed: Jun. 10, 1988

[51] Int. Cl.[5] ..... C10G 67/02

[52] U.S. Cl. ..... 208/99; 208/97; 208/182; 208/102; 208/424

[58] Field of Search ..... 208/424, 177, 182, 298, 208/299, 97, 99, 102, 113

[56] References Cited

U.S. PATENT DOCUMENTS

| | | | |
|---|---|---|---|
| 3,661,774 | 5/1972 | Masobgites | 208/424 X |
| 4,077,881 | 3/1978 | Snell | 208/424 X |
| 4,264,428 | 4/1981 | Schoennagel et al. . | |
| 4,396,489 | 8/1983 | Burke | 208/424 |
| 4,536,277 | 8/1985 | O'Grady et al. | 208/424 X |
| 4,732,664 | 3/1988 | Martini et al. | 208/177 X |

*Primary Examiner*—Glenn Caldarola

*Attorney, Agent, or Firm*—A. J. McKillop; C. J. Speciale; R. D. Stone

[57] ABSTRACT

A process for removing catalyst fines from slurry oil is disclosed. A settling reagent, such as coal, alumina, or coke, is added to a fines containing heavy oil bottoms product from a fractionator downstream of a catalytic cracking unit. The settling reagent promotes rapid settling and removal of fines from heavy oil product. Settling may be performed in a slurry settler, or a centrifuge. A catalytic cracking process for heavy, metals laden oil is also disclosed using a settling reagent to clarify slurry oil, then recycling settled settling reagent to contact the heavy oil in the catalytic cracking process.

8 Claims, 1 Drawing Sheet

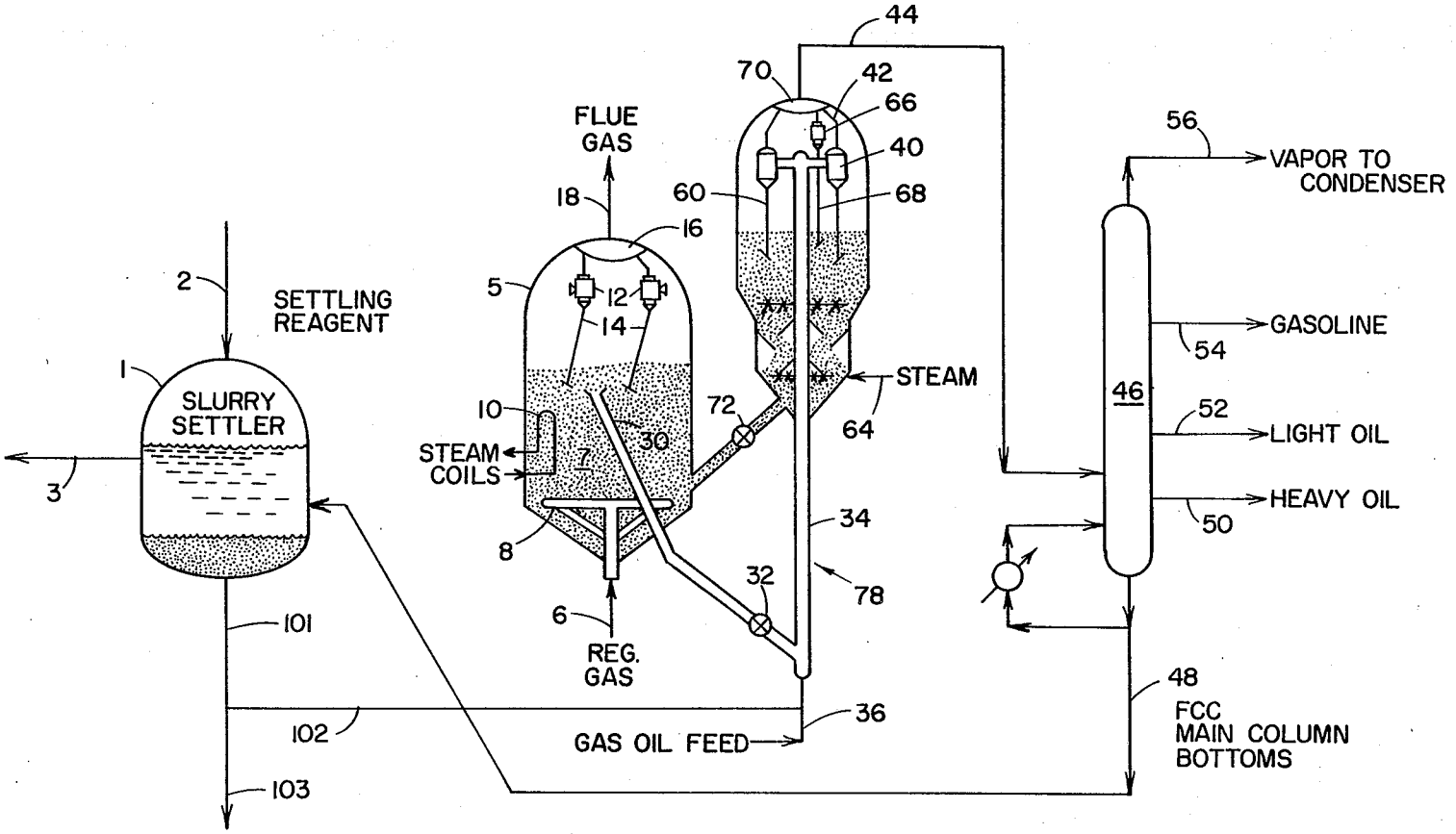
VAPOR TO CONDENSER
GASOLINE
LIGHT OIL
HEAVY OIL
FCC MAIN COLUMN BOTTOMS
STEAM
FLUE GAS
REG. GAS
GAS OIL FEED
STEAM COILS
SETTLING REAGENT
SLURRY SETTLER
56
54
52
50
48
46
44
42
66
40
68
64
34
78
36
70
60
16
72
32
12
14
30
18
5
10
8
6
2
1
3
101
102
103

CLARIFICATION OF SLURRY OIL

BACKGROUND OF THE INVENTION

Clarified Slurry Oil, (CSO), a heavy oil produced as a byproduct of catalytic cracking is an important commercial product. These highly aromatic, high boiling, dense liquids are the hydrocarbon fractions which remain as a bottoms fraction after catalytic cracking.

These materials are primarily used as heavy fuel oil, and to a lesser extent as charge stock for conversion to carbon black or used as aromatic solvents. In many of the downstream uses of these heavy oils, it is important that the oil be free of particulates. Presence of even minor amounts of particulates, such as cracking catalyst "fines", can make the heavy fuel oil totally unsuitable for use in internal combustion engines. The cracking catalyst fines are highly abrasive and difficult to remove by conventional filtering because of their extremely fine size. Fines accumulate in the pistons of the internal combustion engines burning the fuel, so the presence of even small amounts of fines in heavy fuel oil cannot be tolerated.

The problem can be better understood by considering what happens to heavy oil feed in a catalytic cracking unit. Fluidized catalytic cracking (FCC) units are the most popular so the conversion of heavy feed to lighter products in an FCC unit will be described. Similar problems occur in Thermofor catalytic cracking (TCC) units, though the problems are not as severe as in FCC.

Hot, regenerated FCC catalyst contacts the heavy feed in the base of a reactor. The catalyst is present in excess, usually 5 or 10 weights of catalyst per weight of oil. The FCC catalyst has a particle size distribution ranging from 10–100 microns. The FCC catalyst cracks the oil to produce lighter products and is coked in the process. Coked catalyst is separated from cracked products. The coked catalyst is regenerated in a fluidized bed combustion zone or regenerator. The cracked products and entrained catalyst fines are sent to a main fractionation column which separates cracked products into a range of products, gaseous fractions, naphtha, light fuel oil and a bottoms fraction.

Because of the nature of catalytic cracking units, there is always a significant amount of catalyst entrained with the cracked products. Fines are created continuously in the FCC unit, primarily by particles of catalyst bumping into one another, or hitting hard surfaces in the unit. A commercial FCC unit, with 100 tons of equilibrium catalyst, might generate 1000 to 2000 pounds per day of fines. The main fractionation column is designed to accomodate the fines, and any fines carried over into the main column are collected with the bottoms fraction. The bottoms fraction is frequently recycled, at least in part, to the FCC reactor for additional conversion. This recycle sends more catalyst fines back to the FCC reactor, which increases the catalyst fines content of cracked products.

As a practical matter, it is usually not possible to recycle 100% of the material withdrawn from the main column bottoms (MCB). This material is highly aromatic and difficult to crack. Usually the MCB is sent to a slurry settler. Most of the fines settle to the bottom. The oil withdrawn from the bottom of the slurry settler is the slurry phase. The oil withdrawn above the slurry phase is clarified slurry oil. The slurry phase is recycled, and the clarified slurry oil (CSO) withdrawn and sent to a storage tank. Some cooled CSO may be recylced to the slurry settler. During storage, more of the catalyst fines settle to the bottom of the tank leaving an oil phase with a further reduced fines content. However, the settling is slow and, settling never removes all of the catalyst particles. Slurry settling merely removes "fines" that are fairly large, and easy to recover by settling. The finer catalyst particles are removed only with great difficulty by such settling, and the CSO (still with a small but significant amount of extremely fine catalyst fines remaining) is withdrawn and used as a product.

Filtering of the CSO should remove more of the fines and make the product completely suitable for fuel oi, but the particles remaining in the CSO are extremely fine so conventional filtration methods are not as effective as desired in removing this material. The filtration is extremely difficult because the CSO is a dense viscous liquid, and the particulate contaminants to be removed by filtration consist almost exclusively of particles which are so fine that they have resisted hours of high temperature settling in a slurry settler, and in some cases, days of settling tank in a tank.

Some use has been made of slurry oils in FCC. In U.S. Pat. No. 4,264,428 (Schoennagel et al), incorporated herein by reference, a coal liquification process used FCC main column bottoms in a coal solubilization zone. The resulting coal/solvent mixture was then charged to the base of an FCC riser reactor. The process would not reduce the catalyst fines contents of the FCC main column bottoms stream, nor of clarified slurry oil derived therefrom. The solids content of the CSO stream from the coal solubilization zone would increase.

We reviewed the existing ways of preparing a CSO of reduced fines content and could find no completely satisfactory and economical solution to the problem.

We realized conventional methods could not work too well because they allowed the fines to accumulate or build up in the FCC. They also allowed the oil to cool too much, both in the slurry settler and in storage. Once these two conditioners were met, large fines content remaining in the oil and lower temperature oil with increased viscosity, both settling and filtration became difficult.

BRIEF SUMMARY OF THE INVENTION

We discovered a way to clean up the CSO by attacking the problem at its source, i.e., by removing more of the fines in the slurry settler.

Accordingly, the present inventor provides a process for clarifying slurry oil withdrawn from a product fractionator downstream of a catalytic cracking unit characterized by adding to the slurry oil stream a settling reagent which promotes separation of catalyst fines from heavy oil; and separating by a separation means a clarified slurry oil with a reduced fines contents from settled fines and settling reagent and recovering the clarified slurry oil as a product of the process.

In another embodiment the present invention provides a process for clarifying slurry oil withdrawn from a fractionator associated with a catalytic cracking unit characterized in that a metal settling reagent is added to the slurry oil, at a temperature of 250°–450° C., and the settling reagent and catalyst fines are separated from the slurry oil by a physical means within 10–300 minutes, or recycled to the cracker. The reagent is burned in the regenerator or disintegrated and blown off at the exit of the flue gas.

DETAILED DESCRIPTION

Brief Description of the Drawing

The FIGURE illustrates a simplified, schematic process flow diagram of one embodiment of the present invention for clarifying slurry oil from the catalytic cracking unit.

DISCUSSION OF FIGURE

The FIGURE shows one preferred embodiment of the present invention, as applied to an FCC unit. The operation of the FCC unit and FCC main column will be discussed first, followed by a discussion of the slurry settler of the invention.

A conventional gas oil or heavier feed is added via line 36 to the base of FCC riser 34. Atomizing steam may be added via line 76. Hot regenerated FCC catalyst is added to the base of the riser through flow control valve 32. Catalyst and cracked products are discharged into cyclones 40 which separate catalyst from cracked products. Catalyst is discharged into dense bed 28, passes downward through baffles spaced about the riser, and contacts stripping steam added via line 64. The stripped catalyst is passed via flow control valve 72 into regenerator 5. Regeneration gas, usually air, is added via line 6 and distributor 8. Steam coils 10 may be used to remove heat, Flue gas passes through cyclones 12 which recover entrained catalyst via diplegs 14 and pass flue gas into plenum 16 and line 18 for discharge. Hot regenerated catalyst in dense bed 7 is removed via line 30 for reuse.

Cracked products are recovered from the FCC reactor section via the overhead lines 42 of cyclones 40 and the vapor outlet of secondary cyclone 66. Cracked products are removed via plenum chamber 70 and line 44 and discharged into the FCC main column 46. Light vapors are removed overhead via line 56, while gasoline, light oil, and heavy oil are withdrawn via lines 54, 52 and 50 respectively. A bottoms or MCB stream, fractions is withdrawn via line 48 and charged to slurry settler 1.

In slurry settler 1 a settling reagent, such as coal, carbon black, coke or alumina, FCC catalyst, TCC catalyst, and $SiO_2$ is added via line 2. A clarified slurry oil product is withdrawn via line 3. Intermittently, or continuously, a settled sludge fraction is discharged from the base of slurry settler 1 via line 103 and reoved via lines 101 and 103, or recycled to the base of the riser reactor via lines 101 and 102. Many settling reagents, also function as vanadium getters, and recycle of, e.g., coal, coke, alumia, FCC or TCC catalyst and silica and precipitated or settled catalyst fines to the riser to function as a metals sink is beneficial.

Settling Reagent

The settling reagent used can be any material which will function to promote prompt settling of catalyst fines from heavy, aromatic hydrocarbon, at high temperatures.

Most conventional flocculating agents will not work, flocculating agents designed for water treatment systems are utterly unsuitable for use herein.

Preferred materials are relatively high surface area materials such as coal, coke, FCC catalyst, TCC catalyst, porous alumina and silica.

The ideal settling reagent should have the following properties:

D(diameter) = 10–5000 microns

P(density) = 0.6–4 g/cc

Surface area = 10–1000 $m^2/g$

Attrition index = 6–20

The attrition idex is measured by placing a 7 cc catalyst sample in one inch i.d., "U" tube. The catalyst is contacted with an air jet formed by passing humidified (60%) air through a 0.07 inch nozzle at 21 liter/min. for one hour. The attrition index (AI) can be calculated using the amount of fine fractions (0–20 microns) product and packed density correction factor (P.D.).

$$AI = 100 \times (P.D.) \frac{\text{Wt. \% fines } AA - \text{wt. \% fines } BA}{100 - \text{wt. \% fines } BA}$$

where AA = After Attrition; BA = Before Attrition; and fines = wt% (0–20 microns).

If 7 cc of soft material having an average particle size above 20 microns is put in the "U" tube, and all of it is attrited to "fines" of 0–20 microns in an hour, then the attrition index will be 100.

The amount of getter material added is not that critical. It is determined more by economics, and to a lesser extent by the ability of the catalytic cracking unit to tolerate increased production of catalyst fines, than anything else. The most efficient use of getter material will be adding the smallest amount. This will ensure that the getter material is fully loaded with metal. It will usually mean that a significant amount of metal bypasses the getter material and will be deposited on the FCC or TCC catalyst. Depending on the value of eliminating more metal from the feed, it may be desirable to operate with gross excesses of getter material over that required to absorb a majority of the metals in the feed.

At least 25% of the metals present in the feed should be removed on the getter material. Preferably 50%, and most preferably more than 90%, of the metals in the heavy feed are deposited on the getter material.

As the getter material, because of its small size, will usually have at least an order of magnitude more surface area available than the FCC catalyst, and as the getter will usually be a material chosen for its high affinity for metals, the feed will typically contain from 0.01–5 wt % getter material, and preferably from 0.1–1 wt % getter material.

The settling material should have a density, and particle size, which will result in relatively rapid settling of the reagent at the conditions used to remove catalyst fines from the slurry oil.

SETTLING CONDITIONS

It is preferred that the settling reagent be added intermediate the main column and the conventional settling tank used to clarify the slurry oil. It is beneficial to conduct settling while the slurry oil is at a very high temperature, to reduce its viscosity.

In one embodiment, the settling reagent may be added to the slurry oil withdrawn from the main column's bottom, passed through one or more mixing devices to ensure good contact of settling reagent with slurry oil, followed by conventional separation in a settling tank, conventional filter means, or centrifuge.

Settling reagent may be added, and removed, at several different places, e.g., added to and with drawn from the slurry settler, followed by more stages of settling with addition of settling reagent to the CSO.

Additional settling reagent may also be added to the tank used for conventional clarification of the slurry oil stream.

The settling reagent may be added in any convenient form. It may be added as a dry powder, using a screw feeder, lock hopper, or similar means. It may be dispersed as a dry powder into the settling tank. The reagent may be mixed with a compatible fluid, preferably slurry oil, and the resulting slurry or paste added to any desired location.

Settling conditions can include a temperature ranging from that experienced in the main column bottom (typically 250–450) to about 50° C. Ideally, the temperature are much higher than this to reduce the viscosity, and improve the settling of the CSO streams.

Expressed as viscosity, the slurry oil stream should be hot enough so that the viscosity of the slurry oil ranges from 0.5–10 cp and preferably from 1–5 cp.

Pressure should be sufficient to maintain the slurry oil in liquid phase. Normally this will not be a problem because of the high boiling range of this material.

SLURRY OIL PROPERTIES

The typical physical and chemical properties of both a full range and of a topped clarified slurry oil are presented below in Table 1. Topping, or removal of lower boiling materials, will not remove catalyst fines. These fines stay with the bottom fraction.

TABLE I

DISTILLATION OF CLARIFIED SLURRY OIL

| | Full range CSO | Topped CSO |
|---|---|---|
| Yield, vol. percent bottoms | — | 67.0 |
| Specific gravity, 77/77 | 1.069 | 1.1009 |
| Viscosity at 130° F., cs | 149.4 | — |
| Viscosity at 210° F., cs | 11.8 | 38.4 |
| Flash, COC, °F. | 320 | 475 |
| Infrared Index: | | |
| $I_A$ | 0.18 | 0.22 |
| $I_T$ | 0.47 | 0.47 |
| Ratio | 4.04 | 4.19 |
| Vacuum Distillation: | | |
| IBP | 502 | 724 |
| 5% | 615 | 768 |
| 10% | 676 | 786 |
| 20% | 719 | 805 |
| 30% | 747 | 814 |
| 40% | 759 | 824 |
| 50% | 786 | 841 |
| 60% | 803 | 862 |
| 70% | 832 | 882 |
| 80% | 876 | 927 |
| 90% | 933 | 1,019 |
| Sulfur, wt. percent | — | 0.92 |
| Carbon, wt. percent | 90.03 | 90.53 |
| Hydrogen, wt. percent | 8.01 | 777 |
| Elution chromatography, wt. percent: | | |
| Saturates | 17.1 | 13.3 |
| Mono and dinuclear aromatic oils | 4.3 | 2.5 |
| Polynuclear aromatic oil | 27.2 | 25.1 |
| Soft resins | 25.4 | 31.4 |
| Hard resins | 9.3 | 11.7 |
| Eluted asphaltenes | 9.3 | 13.4 |
| Non-eluted asphaltenes | 7.4 | 2.6 |
| Nuclear Magnetic Resonance: | | |
| Aromatics condensed | 22.8 | 25.2 |
| Aromatics uncondensed | 6.6 | 6.7 |
| $CH_2$, CH, alpha to aromatic | 18.5 | 21.4 |
| $CH_3$, alpha to aromatic | 10.7 | 10.1 |

TABLE I-continued

DISTILLATION OF CLARIFIED SLURRY OIL

| | Full range CSO | Topped CSO |
|---|---|---|
| Naphthalene | 7.5 | 6.8 |
| Methylene | 19.7 | 17.4 |
| Methyl | 14.2 | 12.6 |
| Aniline point mixed | — | 112.5 |

Based on our experience, if practicing the invention now we would use as a settling reagent commercially available alpha-alumina, such as that available from Alcoa. We would disperse this evenly, from the top of the slurry settling tank. We would take a representative sample of unclarified slurry oil from the main column bottoms, and test it in a laboratory to determine the optimum amount of alumina to add to this stream. Depending on the efficiency of dispersing the alumina powder in the surry settling tank, and temperature and residence time in the slurry settler, we would see significant improvement in slurry oil clarification by adding as little as 0.1 g/liter of slurry oil, but prefer to operate with much greater amounts of alumina, preferably around 1–20 weight percent alumina.

We would maintain the temperature of the settling tank at 250°–450° C., and ensure a residence time of 30–300 minutes. We would remove the settled fines and alumina by pumping it from the bottom of the settling tank. The alumina is then preferably charged to the catalytic cracking unit, to act as a metals getter.

We claim:

1. A process for clarifying slurry oil withdrawn from a fractionator associated with a catalytic cracking unit characterized by adding a settling reagent having a particle size of 20–5000 microns and a particle density of 0.6–4 g/cc which to the slurry oil at a temperature of 250–450 C., separating the settling reagent and catalyst fines from the slurry oil by a physical means within 10–300 minutes, to produce a clarified slurry oil product and settled fines and settling reagent and recycling at least a portion of the settled fines and settling reagent to the catalytic cracking unit.

2. The process of claim 1 further characterized by separating in a settling zone settling reagent and catalyst fines from a clarified slurry oil product.

3. The process of claim 1 further characterized by centrifugal separation of additive and catalyst fines from clarified slurry oil product.

4. The process of claim 1 further characterized in that the settling reagent is selected from the group of coal, alumina, coke carbon black and FCC and TCC catalyst.

5. The process of claim 1 further characterized in that the settling reagent has an attrition index of 6–20 and a surface area of 10–1000 meters square per gram.

6. The process of claim 1 further characterized in that the catalytic cracking unit is a fluidized catalytic cracking unit.

7. The process of claim 1 further characterized in that the catalytic cracking unit is a moving bed catalytic cracking unit.

8. A process for catalytic cracking of a heavy hydrocarbon feed containing nickel and vanadium to lighter products including a clarified slurry oil by (1) cracking the heavy feed in a catalytic cracking zone with regenerated catalytic cracking catalyst in the presence of an additive which has a high affinity for nickel and vanadium contained in the heavy feed to produce cracked products containing catalyst fines, coked cracking catalyst and additive containing an increased metals content as a result of metals deposition during catalytic cracking;

(2) separating cracked products containing catalyst fines from coked catalyst;

(3) regenerating coked catalyst in a catalyst regenerator associated with the FCC unit and recycling the regenerated catalyst to the catalytic cracking zone;

(4) fractionating in a distillation column the cracked products containing catalyst fines to produce naphtha and gas oil liquid product fractions substantially free of catalyst fines and a slurry oil bottoms fraction containing catalyst fines;

(5) clarifying the slurry oil by adding to the slurry oil 1–20 weight percent of an additive reagent having a particle size of 20–5000 microns and a particle density of 0.6–4 g/cc which has a high affinity for nickel and vanadium and which promotes separation of catalyst fines from slurry oil and separating by a separation means a clarified slurry oil product with a reduced fines content from settled fines and additive; and (6) recovering settled additive from the separation means and charging at least a portion of the settled additive to the catalytic cracking zone.

* * * * *